US005351819A

United States Patent [19]

Varon

[11] Patent Number: 5,351,819

[45] Date of Patent: Oct. 4, 1994

[54] SLEEP THERAPY PACKAGE

[75] Inventor: Steven C. Varon, Neshanic Station, N.J.

[73] Assignee: Carter-Wallace, Inc., New York, N.Y.

[21] Appl. No.: 165,385

[22] Filed: Dec. 10, 1993

[51] Int. Cl.[5] ..... B65D 71/00

[52] U.S. Cl. ..... 206/232; 206/570; 206/531; 206/534; 206/491; 229/120.38; 229/151

[58] Field of Search ..... 206/232, 570, 531, 534, 206/491; 229/120.38, 151

[56] References Cited

U.S. PATENT DOCUMENTS

| | | | |
|---|---|---|---|
| 3,641,684 | 2/1972 | Paige | 206/232 X |
| 4,168,028 | 9/1979 | McCall | 229/151 X |
| 4,189,053 | 2/1980 | Stagnitto et al. | 206/232 X |
| 4,889,238 | 12/1989 | Batchelor | 206/232 X |
| 4,890,741 | 1/1990 | Edelstein | 206/232 X |
| 4,925,033 | 5/1990 | Stoner | 206/232 X |
| 5,022,522 | 6/1991 | Kennedy | 206/232 X |
| 5,046,609 | 9/1991 | Mangini et al. | 206/232 |
| 5,103,972 | 4/1992 | Ackeret | 206/232 |

FOREIGN PATENT DOCUMENTS

| | | | |
|---|---|---|---|
| 719976 | 10/1965 | Canada | 206/232 |
| 2663001 | 12/1991 | France | 229/151 |

*Primary Examiner*—William I. Price
*Attorney, Agent, or Firm*—Watov & Kipnes

[57] ABSTRACT

A package for dispensing items for use in sleep therapy comprising a box having two compartments and a lid, packs of doses of sleep inducing medicine in one compartment, each pack containing at least one placebo, and envelopes in the other compartments, each of the envelopes containing an audiogenic recording for inducing sleep, statements required by law relating to the medicine and instructions for using the medicine and the recording. The box is comprised of a bottom having extended ends that fold over so that tongues at their ends are inserted into slits in the bottom, thus forming channels, a folded front having tabs at its ends that are inserted in the front of said channels, a foldable back having tabs at its ends inserted into the rear of said channels, and a lid folded from said back, the lid having foldable tabs at its sides adapted to be adjacent the inner surfaces of the sides of the box, and a foldable section at the front of the lid having curved tabs at its ends that can be inserted into the fronts of said channels.

16 Claims, 4 Drawing Sheets

SLEEP THERAPY PACKAGE

RELATED APPLICATION

The present invention is related to that of co-pending application Ser. No. 08/165,386, entitled "Sleep Therapy System" filed on the same date herewith.

FIELD OF THE INVENTION

The present invention relates generally to the field of product packaging, and more particularly to the packaging of sleep therapy systems for prescription by physicians.

BACKGROUND OF THE INVENTION

Physicians and others are deluged with all kinds of medical remedies that they in turn dispense to patients. It is important that the packages in which they receive these products be convenient to use and store. Of growing importance are products that can be used to induce sleep.

SUMMARY OF THE INVENTION

In accordance with this invention, a sleep therapy package is provided having one compartment for envelopes containing audiogenic sleep-inducing recordings, patient instructions regarding medication as required by law, and instructions for the sleep therapy procedures to be followed. Another compartment is provided for separate packs of sleep-inducing medicine. In order to prevent a user from becoming dependent on the medicine, each pack contains at least one placebo.

The package comprises a box having a body portion, a lid and a partition for dividing the body portion into two compartments, one for the envelopes and one for the packs of medicine. The latter compartment is provided with an opening through which fingers can be inserted so as to more easily remove the packs one at a time.

In order to provide the stiffness required to enable other boxes to be stacked on top of it, the box of the sleep therapy package of this invention is constructed so as to have, when closed, a front wall having two layers of the sheet material from which the box is constructed and side walls having four layers. The partition within the box extends from the top to the bottom so as to provide additional stiffening. And, in order to secure the lid firmly in place, it is provided with a flap overlapping the front wall of the body portion and patches of Velcro ® on the adjacent surface of each for releasably sticking them together, in this example. The lid is also secured by tabs at the ends of the flap that are shaped so that they can be inserted between the outer two layers of the sidewalls.

BRIEF DESCRIPTION OF THE DRAWINGS

Various embodiments of the present invention are described below with reference to the drawings, wherein similar items are identified by the same reference designation, in which.

DETAILED DESCRIPTION OF THE INVENTION

Figure 1:
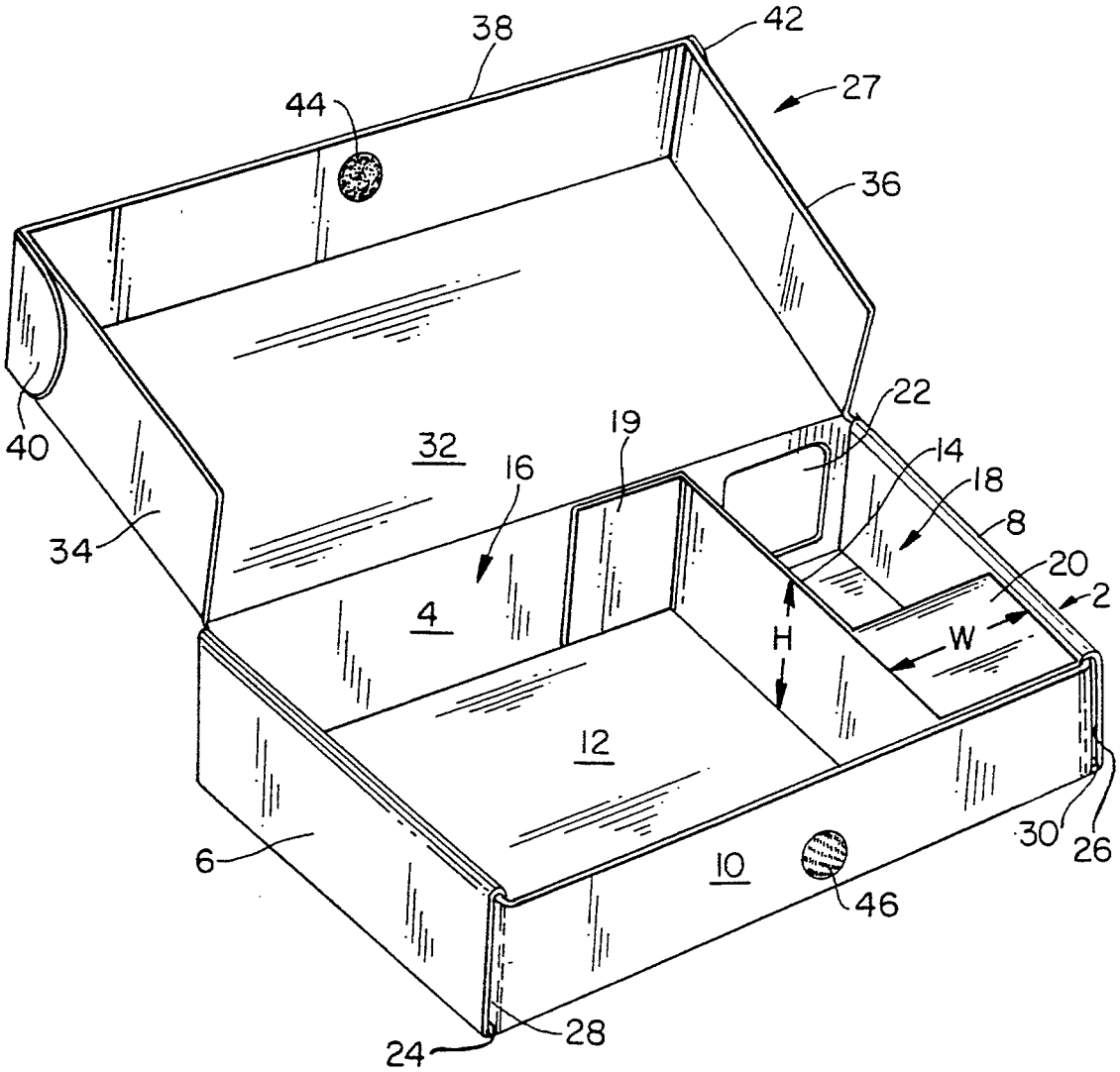
FIG. 1 is an isometric view of an open box and the compartments therein that are to respectively contain the envelopes and medicine pads of the sleep therapy package of this invention.

Reference is made to FIG. 1 showing the box for the sleep therapy package of this invention in an open position. Its body 2 is comprised of a rear wall 4, two side walls 6 and 8, a front wall 10 and a bottom 12. A partition 14 divides the body of the box into a large compartment 16 and a smaller compartment 18. The corner 20 of the body 2 is closed off on all sides so that the compartment 18 extends only part way from the rear wall 4 to the front wall 10. A tab 19 on the rear of the partition 14 bears against the rear wall 4 so as to hold that end of the partition 14 in place. An aperture 22 in the rear wall 4 provides access to the compartment 18. As will be more evident from FIG. 4, the side walls 6 and 8 fold in half and are provided with tabs, not shown in FIG. 1, that extend through slits, also not shown, in the bottom 12 so as to provide channels 24 and 26. Tabs 28 and 30 at the ends of the front wall 10 respectively fit into the front ends of these channels 24 and 26, respectively, thus holding the front wall 10 in position. Although not shown, the rear wall 4 has hinged tabs at its ends that fit into the rear ends of the channels 24 and 26.

The lid 27 of the box is comprised of a top 32 having sidewalls 34 and 36 and a front wall 38 that are hinged thereto at fold lines. Tabs 40 and 42 are hinged to the ends of the front wall 38. When the lid 27 is closed, its side walls 34 and 36 fit inside the side walls 6 and 8 of the body portion, and the tabs 40 and 42 are inserted into the front ends of the channels 24 and 26 between the tabs 28 and 30 and the outsides of the side walls 6 and 8.

In order to keep the box firmly shut, patches 44 and 46 of a substance like Velcro ® are respectively placed on the inside of the front wall 38 of the lid 27 and the outside of the front wall 10 of the body portion of the box.

From this description, it is seen that each side wall of a closed box is comprised of four layers of material, i.e., the inner and outer sides of the side wall, the tab such as 28 that is hinged to the front wall 10 as well as a tab, not shown, that is hinged to the rear wall 4, and the sides 34 and 36 of the lid. The front of the box has two layers, the front wall 10 of the body portion and the front wall 38 of the lid 27. With this construction, the box remains shut when closed and is capable of being stacked with other boxes.

Figure 2:
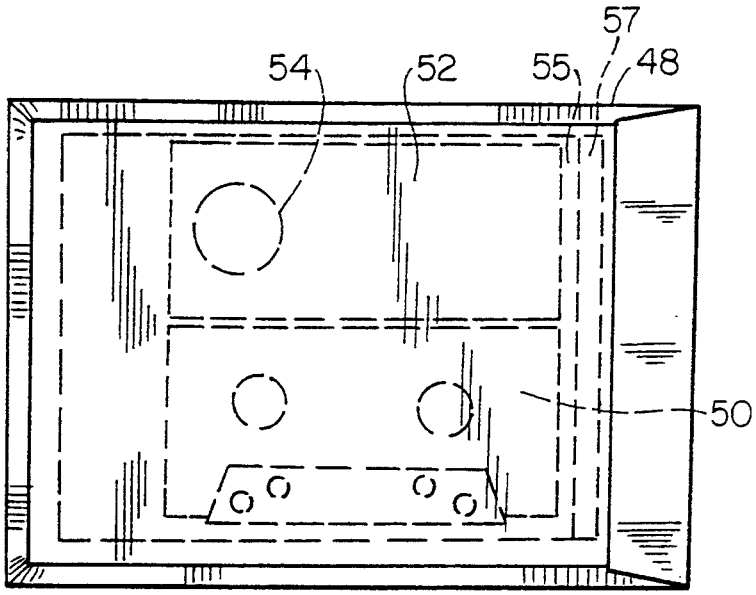
FIG. 2 illustrates one of the envelopes and the contents therein contained in the sleep therapy package of this invention.
Figure 3:
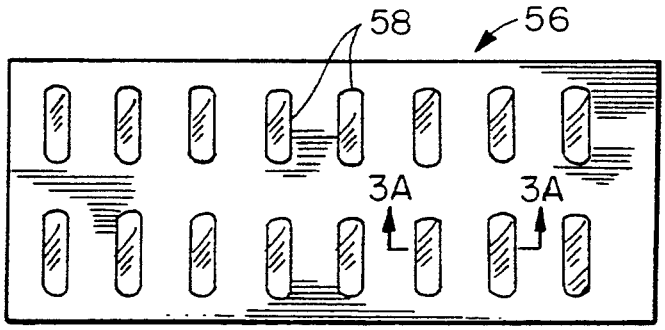
FIG. 3 is a top view of a pack of doses of sleep inducing medicine.
Figure 3A:
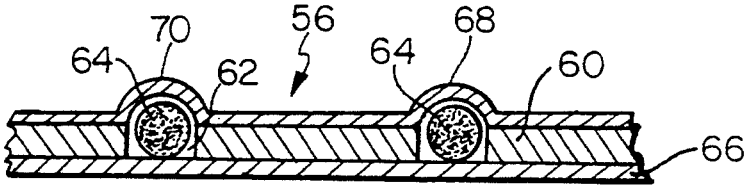
FIG. 3A is a cross section taken along 3A—3A of FIG. 3.

In accordance with this invention, packs of sleep inducing medicine such as shown in FIGS. 3 and 3A are stored in the compartment 18, and envelopes such as 48 of FIG. 2 are stored in the larger compartment 16. Each envelope 48 has within it a recording, herein shown in phantom as being a tape recording 50 of audiogenic program material created for the purpose of inducing sleep. An inexpensive playback mechanism 52 can also be included that has a loudspeaker 54. Also included in each envelope 48 are printed patient instructions sheets 55 relating to the medicine as required by law, and procedures 57 for using the recording in combination with the medicine. A listing of other audiogenic sleep therapy programs and order forms therefore may also be included as well as a questionnaire relating to the user's experience in using the sleep therapy package.

An example of the instructions for use of the sleep therapy package is as follows:

1. Take DORAL® Tablets, as directed by your doctor, until your supply runs out. This will be one tablet each night at a specified time before you go to bed.
2. After taking a DORAL® Tablet, listen to the audio relaxation cassette while lying in bed.
3. Follow the tips on how to create a restful sleep environment.
4. Continue listening to the audio relaxation cassette for at least 5 days after your supply of DORAL® Tablets is finished.
5. Before starting therapy, complete questions 1 to 3 of the questionnaire; complete question 4 after 3 days of therapy; and complete questions 5 to 14 five days after completing the DORAL® Tablets component of the program.
6. Return the top part to your doctor and mail the bottom two copies to the address printed on the questionnaire.

Other comments on supplies needed, how to get the most out of the audio recording, how to create a restful sleep environment, what to do and not to do while taking sleep medication, as well as answers to commonly asked questions may also be included in the instructions.

Separate packs of sleep inducing medication such as indicated at 56 of FIGS. 3 and 3A are stored in the smaller compartment 18 of FIG. 1. The top view of FIG. 3 shows a plurality of blisters or blister cells 58 such as further illustrated in the cross-sectional view of FIG. 3A. A sheet of cardboard 60 has apertures 62 therein, and capsules or tablets 64 of medicine are placed in each aperture. A thin sheet of easily ruptured material 66, such as metal foil, is adhered to the bottom of the cardboard sheet 60, and a sheet 68 of preferably transparent deformable material is adhered to the top of the cardboard sheet 60. The sheet 68 is preferably made of plastic with blisters 70 formed therein in registration with the apertures 62 so as to hold the capsules 64 in their respective apertures 62. Thirty or more capsules or tablets 64 may be provided in each pack 56, and it is important that some of the capsules or tablets 64 be placebos. When a capsule or tablet 64 is desired, pressure is applied to a blister 70 so as to force a capsule 64 against the sheet 66 and rupture it. Other forms of packs may be used, but in any case, single packs 56 may be extracted from the compartment 18 by inserting fingers through the opening 22.

Figure 4:
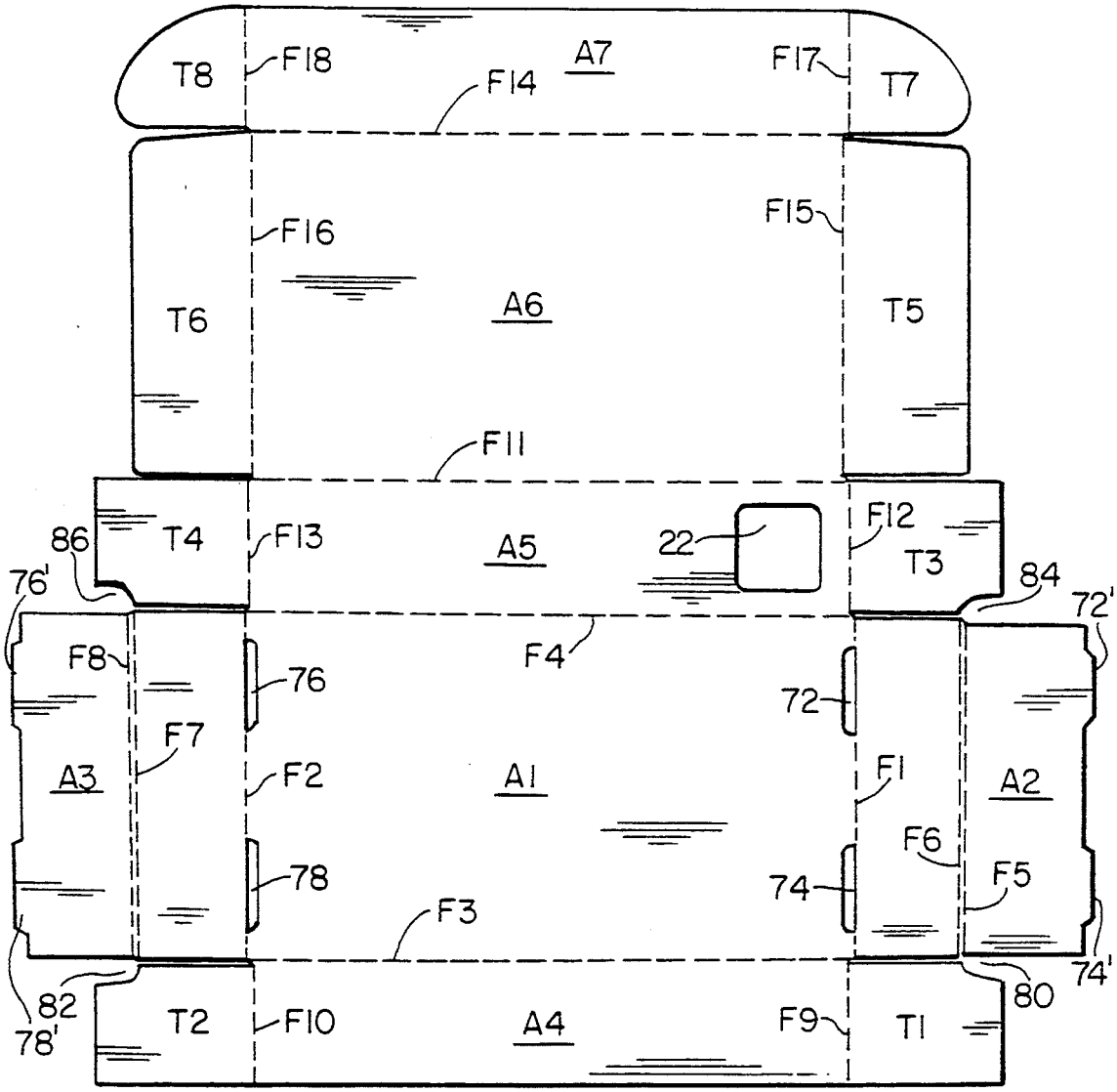
FIG. 4 shows a blank from which the box of FIG. 1 is formed.

Reference is made to FIG. 4 showing a blank from which the box of FIG. 1 may be formed. Fold lines at which the material of the blank is to be folded in order to form the box are indicated by dashed lines, and edges of the blank are shown in solid lines.

A rectangular area A1 that is to be the bottom 12 of the box is shown as being bounded by fold lines F1 and F2 at its ends and F3 and F4 at its sides. Slits 72 and 74 are formed in the area A1 adjacent and parallel to the fold line F1, and slits 76 and 78 are formed in the area A1 adjacent and parallel to the fold line F2. A rectangular area A2 extending from the fold line F1 has closely spaced fold lines F5 and F6 close to and on opposite sides of the center that are parallel to the fold line F1 and tongues 72' and 74' at the end remote from the fold line F1. A rectangular area A3 extending from the fold line F2 is constructed in the same manner as A1 so as to have fold lines F7, F8 and tongues 76' and 78'.

A rectangular area A4 that forms the front wall 10 of the box of FIG. 1, extends from the fold line F3 and has fold lines F9 and F10 at the ends that are slightly inside of and parallel to the fold lines F1 and F2, respectively. Tabs T1 and T2, which are indicated at 28 and 30 of FIG. 1, extend from the fold lines F9 and F10. The tabs T1 and T2 have a length equal to one half the length of the fold lines F1 and F1, for example. A notch 80 is cut in the outer corner of the tab T1 that is adjacent the area A2, and a notch 82 is cut on the outer corner of the tab T2 that is adjacent the area A3.

The back 4, as shown in FIG. 1, of the body portion 2 is formed by a rectangular area A5 bounded by the fold lines F4, a fold line F11 that is parallel to F4, and fold lines F12 and F13 that are coextensive with the fold lines F9 and F10 and therefore just inside of the fold lines F1 and F2. Tabs T3 and T4 respectively extend from the fold lines F12 and F13 and have a length equal to one half the length of the fold lines F1 and F2. Notches 84 and 86 are formed in the outer corner of the tabs T3 and T4 that are respectively adjacent the areas A2 and A3.

The top 32 of the lid 27, as shown in FIG. 1, is formed by a rectangular area A6 of FIG. 4 that is bounded by the fold line F11, a fold line F14 that is parallel to the fold line F11, and the fold lines F15 and F16 that are parallel to one another and to the fold lines F12 and F13, respectively. Fold lines F12 and F13 are just outside of fold lines F15 and F16, respectively. The distance between the fold lines F11 and F14 is preferably slightly larger than the distance between the fold lines F3 and F4.

Tabs T5 and T6 that form the side walls 36 and 34 of the lid 27, as shown in FIG. 1, respectively extend from sections of the fold lines F15 and F16, and have a width preferably equal to the length of the fold lines F9, F10, F12 and F13.

The distance between fold lines F17 and F18 is greater than that between F15 and F16, about equal to that between F12 and F13, about equal to that between F9 and F10, and less than the distance between F1 and F2.

The front wall 38, as shown in FIG. 1, of the lid 27 is formed by a rectangular area A7 bounded by the fold line F14 and opposing fold lines F17 and F18. The fold line F17 is coextensive with and has the same length as the fold lines F9 and F12, and the fold line F18 is coextensive with and has the same length as the fold lines F10 and F13. The tabs T7 and T8 are generally shaped like a quarter circle so that they can be inserted into the front of the channels 24 and 26 when the box is assembled.

The box is assembled from the blank of FIG. 4 by folding the areas A4 and A5 so that they are perpendicular to the area A1, and respectively folding the tabs T1 through T4 inward toward the slits 74, 78, 72 and 76. The area A2 is then folded on its fold lines F5 and F6 over the tabs T1 and T3, and its tongues 72' and 74' are respectively inserted into the slits 72 and 74. The area A3 is folded on its fold lines F7 and F8 over the tabs T2 and T4 and its tongues 76' and 78' are respectively inserted into the slits 76 and 78. The area A6 is then folded on the fold line F11, while at the same time folding the tabs T5 and T6 so that they are respectively inside the folded areas A2 and A3 and inserting the curved tabs T7 and T8 into the channels 24 and 26 formed by the folding of A3 and A2, respectively. Specifically, the tab T7 will be between the tab T1 and the half of A2 adjacent the fold line F1, and the tab T8 will be between the tab T2 and the half of A3 adjacent the fold line F2.

If the tabs T1 through T4 were curved like the tabs T7 and T8, the areas A2 and A3 could be folded first, but this would reduce the strength of the side walls. In any event, the tabs T7 and T8 have to be curved because the lid 27 is closed after the body portion of the box is formed.

Figure 5:
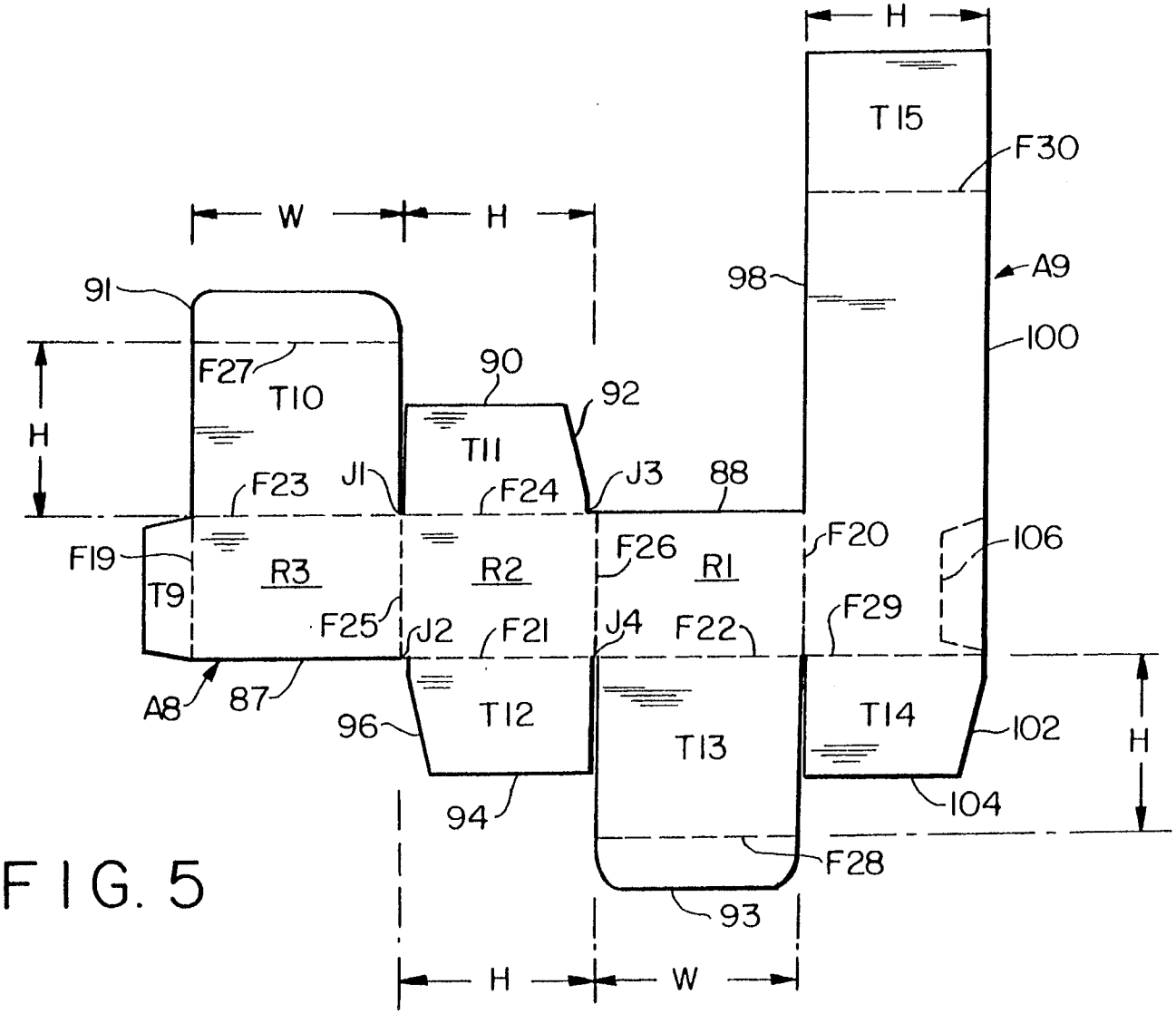
FIG. 5 shows a blank from which the partition of FIG. 1 is formed.

Reference is now made to FIG. 5 for a description of a blank for forming the partition 14 of FIG. 1 that separates the body 2 of the box into the compartments 16 and 18. The blank is comprised of a rectangular area A8 that is bounded by fold lines F19 and F20 at its ends, a first side comprised of an edge 87 and fold lines F21 and F22 that are coextensive therewith and a second side comprised of fold lines F23 and F24 and an edge 88 that are coextensive. The area A8 is subdivided into rectangular areas R1, R2 and R3 by fold lines F25 and F26 that are parallel to the end fold lines F19 and F20. The fold line F25 extends between the junction J1 of the fold lines F23 and F24, and the junction J2 of the edge 87 and the fold line F21. The fold line F26 extends between the junction J3 of the fold line F24 and the edge 88 and the junction J4 of the fold lines F21 and F22.

A tab T9 extends from the fold line F19, and a tab T10 extends from the fold line F23. A fold line F27 in the tab T10 is parallel to the fold line F23 and a tip 91 extends from it. A tab T11 extends from the fold line F24; a tab T12 extends from the fold line 21; and a tab T13 extends from the fold line F22. A fold line F28 in the tab T13 is parallel to the fold lines F22, and tip 93 extends from it.

Attention is called to the height H and width W of the insert 14 in FIG. 1 and to the dimensions of H and W in the blank of FIG. 5. Although H and W could be equal so as to form a cube for filling the corner 20 of FIG. 1, W is slightly larger than H in the particular example shown.

Particular attention is called to the shapes and dimensions of the tabs T11 and T12. The maximum width of the tab T11 occurs at the fold line F24 and extends only part way between the junction J1 and the junction J3. The length of T11 is considerably less than the dimension W, the width of its tip 90 is less than the maximum width where it joins the fold line F24, and a tapered edge 92 extends from the tip 90 toward the fold line F24 on the side that is closer to the junction J3. The length of the tab T12 is considerably less than the dimension W, the width of its tip 94 is less than the maximum width where it joins the fold line F21, and a tapered edge 94 extends from the tip 94 toward the fold lines F21 on the side that is closer to the junction J2.

A second rectangular area A9 has ends at fold lines F29 and F30. One side of A9 is formed by an edge 98 and the fold line F20, which, it will be recalled, is also one end of AS. The edge 98 is coextensive with the fold line F20 so as to be perpendicular to the edge 88. The other side of A9 is formed by an edge 100 extending between the fold lines F29 and F30. A tab T14 extends from the fold line F29 and has a length, as shown herein by way of example, that is the same as the length of the tabs T11 and T12. A tapered edge 102 extends from the tip 104 of T14 toward the edge 100. A tab T15 extends from the fold line F30 and forms the tab 19 of FIG. 1. The length of the edge 100 equals the distance between the front and rear walls 4 and 10 of FIG. 1.

In assembling the partition 14 from the blank of FIG. 5, the area A9 is folded at the fold line F20 so as to be perpendicular to the rectangular area R1, and the rectangular area R2 is folded on the fold line F26 so as to be perpendicular to R1. The tabs T14, T11 and T12 are then folded on their respective fold lines F28, F24 and F21 so as to be perpendicular to R1. When this is done, the tab T10 is folded on the fold line F23 and its tip 91 is inserted between R1 and the tapered edge 92. At the same time, the rectangular area R3 is folded on the fold line F25, and the tab T9 is folded on its fold line F19 and inserted along the inside of A9 so as to have a portion as indicated by the dashed line 106 in FIG. 5. At this point, the tab T13 is folded on the fold line F22 and its tip is inserted between R3 and the tapered edges 96 of T12 and 106 of T14. Other sequence folding can be used.

Although various embodiments of the invention have been shown and described herein, they are not meant to be limiting. Those of skill in the art may recognize modifications to these embodiments, which modifications are meant to be covered by the spirit and scope of the appended claims.

What is claimed is:

1. A sleep therapy package comprising:

a box having side walls, a bottom and a lid;

a partition dividing the box into first and second compartments;

a plurality of envelopes in said first compartment;

each of said envelopes respectively containing at least one playable audiogenic recording for inducing sleep; and a plurality of packs of medical doses to be used for sleep inducement in said second compartment.

2. A package as set forth in claim 1, wherein some of said doses in each pack are sleep inducing medicine, and some of said doses are placebos.

3. A package as set forth in claim 1, further comprising means defining an opening in a wall of said box in registration with said second compartment for aiding a user in extracting said packs from said second compartment.

4. A package as set forth in claim 1, wherein at least some of said audiogenic recordings are in a male voice.

5. A package as set forth in claim 1, wherein at least some of said audiogenic recordings are in a female voice.

6. A package as set forth in claim 1, further comprising:

instructions within each envelope for using the recording and the doses.

7. A package as set forth in claim 1, further comprising:

a list within each envelope of audiogenic recordings for inducing sleep and descriptive material therefor.

8. A package as set forth in claim 1, further comprising ordering information within each envelope for audiogenic programs.

9. A package as set forth in claim 1, further comprising means for playing a recording in at least some of said envelopes.

10. A package as set forth in claim 1, further comprising instructions required by law relating to the medicine.

11. A box formed from a first blank, said box including a second blank forming a partition therein, comprising:

said first blank including:

a first rectangular area bounded by first, second, third, and fourth fold lines at first and second ends and first and second sides, respectively;

means defining at least one slit in said first rectangular area extending along each of said first and second fold lines at said first and second ends of said first rectangular area;

second and third rectangular areas respectively extending from said first and second fold lines, respectively, at the ends of said first rectangular area;

fifth and sixth fold lines in said second and third rectangular areas parallel to said first and second fold lines, respectively, at the ends of said first rectangular area;

at least one tongue at the ends each of said second and third rectangular areas adapted for insertion into said slits when said second and third rectangular areas are folded along their fifth and sixth fold lines, respectively;

a fourth rectangular area extending from said third fold line along said first side of said first rectangular area and further defined by seventh and eighth fold lines that are inside said first and second fold lines at the ends of said first rectangular area;

first and second tabs respectively extending from said seventh and eighth fold lines;

a fifth rectangular area extending from said fourth fold line at the second side of said first area, and further defined by ninth and tenth fold lines that are parallel to and inside said first and second fold lines, respectively, at the first and second ends of said first area and an eleventh fold line that is parallel to said fourth fold line at the second side of the said first area;

third and fourth tabs respectively extending from said ninth and tenth fold lines;

seventh and sixth tabs extending from portions of said first and second fold lines that extend beyond said third fold line;

a sixth rectangular area extending from said eleventh fold line, and further defined by twelfth and thirteenth fold lines that are inside said ninth and tenth fold lines and parallel thereto, respectively, and a fourteenth fold line that is parallel to said eleventh fold line;

fifth and sixth tabs respectively extending from said twelfth and thirteenth fold lines;

a seventh rectangular area extending from said fourteenth fold line and further defined by fifteenth and sixteenth fold lines that are respectively coextensive with said twelfth and thirteenth fold lines;

seventh and eighth tabs respectively extending from said fifteenth and sixteenth fold lines;

said second blank including:

a first rectangular area defined by first and second fold lines at its ends, one side being along a first edge and third and fourth fold lines in the order named between said first and second fold lines, the other side being along fifth and sixth fold lines and a second edge in the order named between said first and second fold lines;

seventh and eighth fold lines parallel to said first and second fold lines dividing said first rectangular area into three rectangles;

a first tab extending from said first fold line;

a second tab extending from said fifth fold line, said second tab having a ninth fold line therein parallel to said fifth fold line;

a third tab extending from said sixth fold line;

a fourth tab extending from said third fold line;

a fifth tab extending from said fourth fold line and having a therein tenth fold line parallel to said fourth fold line and at a distance d therefrom;

a second rectangular area having ends at eleventh and twelfth fold lines, the eleventh fold line being coextensive with said first edge of said first rectangular area, one side being along a third edge and the other side being along said second fold line, and a fourth edge in the order named from said eleventh fold line;

a sixth tab extending from said eleventh fold line; and a seventh tab extending from said twelfth fold line.

12. A box as set forth in claim 11, wherein said seventh and eighth tabs of said first blank are each generally quadrantal shaped.

13. A box as set forth in claim 11, wherein said first blank further includes means defining an opening in said fifth rectangular area.

14. A package of elements for sleep inducing therapy comprising:

a box having a bottom with slits therein adjacent the ends;

the sides of said box being formed from extensions of the bottom having tongues at their ends, the extensions being folded so that the tongues are inserted in said slits so as to form channels;

the front of said box being formed from a foldable extension of the bottom having foldable tabs at either end that are inserted in said channels;

the back of said box being formed from a foldable extension of the bottom having foldable tabs at either end that are inserted in said channels;

a partition for dividing said box into first and second compartments;

a lid for said box formed from a foldable extension of said back;

said lid having foldable extensions of the sides thereof adapted to be adjacent the nearer surfaces of said sides of said box when the lid is closed;

a plurality of packs of doses of medicine in said first compartment; and a plurality of envelopes in said second compartment, the envelopes containing audiogenic recordings for inducing sleep and instructions for using said recording and said doses of medicine.

15. A package as set forth in claim 14, wherein each pack of doses of medicine includes doses for inducing sleep and at least one dose that is a placebo.

16. A package as set forth in claim 15, wherein means are provided for defining an opening in the back of said box that is in registration with said first compartment.

* * * * *